US008919063B2

(12) United States Patent
Oldorff

(10) Patent No.: US 8,919,063 B2
(45) Date of Patent: Dec. 30, 2014

(54) BUILDING BOARD HAVING A PATTERN APPLIED ONTO SIDE SURFACES AND CONECTING MECHANISMS THEREOF

(75) Inventor: Frank Oldorff, Schwerin (DE)

(73) Assignee: Flooring Technologies Ltd., Pieta (MT)

( * ) Notice: Subject to any disclaimer, the term of this patent is extended or adjusted under 35 U.S.C. 154(b) by 1542 days.

(21) Appl. No.: 11/470,858

(22) Filed: Sep. 7, 2006

(65) Prior Publication Data

US 2007/0059492 A1 Mar. 15, 2007

(30) Foreign Application Priority Data

Sep. 8, 2005 (DE) ..... 10 2005 042 658

(51) Int. Cl.
*E04F 15/02* (2006.01)

(52) U.S. Cl.
CPC ..... *E04F 15/02033* (2013.01); *E04F 15/02038* (2013.01); *E04F 15/02* (2013.01)
USPC ..... 52/313; 52/591.1; 428/192

(58) Field of Classification Search
USPC ..... 52/313, 311.1, 591.1; 428/192
See application file for complete search history.

(56) References Cited

U.S. PATENT DOCUMENTS

| | | | |
|---|---|---|---|
| 213,740 | A | 4/1879 | Conner |
| 623,562 | A | 4/1899 | Rider |
| 714,987 | A | 12/1902 | Wolfe |
| 753,791 | A | 3/1904 | Fulghum |
| 1,407,679 | A | 2/1922 | Ruthrauff |
| 1,454,250 | A | 5/1923 | Parsons |
| 1,468,288 | A | 9/1923 | Een |
| 1,477,813 | A | 12/1923 | Daniels |
| 1,510,924 | A | 10/1924 | Daniels et al. |
| 1,540,128 | A | 6/1925 | Houston |
| 1,575,821 | A | 3/1926 | Daniels |
| 1,602,256 | A | 10/1926 | Sellin |
| 1,602,267 | A | 10/1926 | Karwisch |
| 1,615,096 | A | 1/1927 | Meyers |
| 1,622,103 | A | 3/1927 | Fulton |
| 1,622,104 | A | 3/1927 | Fulton |
| 1,637,634 | A | 8/1927 | Carter |
| 1,644,710 | A | 10/1927 | Crooks |
| 1,660,480 | A | 2/1928 | Daniels |
| 1,714,738 | A | 5/1929 | Smith |
| 1,718,702 | A | 6/1929 | Pfiester |
| 1,734,826 | A | 11/1929 | Pick |
| 1,764,331 | A | 6/1930 | Moratz |
| 1,776,188 | A | 9/1930 | Langb'aum |
| 1,778,069 | A | 10/1930 | Fetz |

(Continued)

FOREIGN PATENT DOCUMENTS

| | | |
|---|---|---|
| CA | 991373 | 6/1976 |
| CA | 2252791 | 5/1999 |

(Continued)

*Primary Examiner* — Michael Safavi
(74) *Attorney, Agent, or Firm* — Andrew M. Calderon; Roberts Mlotkowski Safran & Cole, P.C.

(57) ABSTRACT

A building board, in particular a flooring panel of wooden material is provided. The building board includes a top and an underside, in which at least the top is provided with a decorative layer imitating a natural material. The building board further includes connecting mechanisms corresponding to one another and peripheral side surfaces. At least one side surface and at least one connecting mechanism is provided with a pattern.

11 Claims, 3 Drawing Sheets

(56) References Cited

U.S. PATENT DOCUMENTS

| | | | |
|---|---|---|---|
| 1,779,729 | A | 10/1930 | Bruce |
| 1,787,027 | A | 12/1930 | Wasleff |
| 1,823,039 | A | 9/1931 | Gruner |
| 1,859,667 | A | 5/1932 | Gruner |
| 1,898,364 | A | 2/1933 | Gynn |
| 1,906,411 | A | 5/1933 | Potvin |
| 1,921,164 | A | 8/1933 | Lewis |
| 1,929,871 | A | 10/1933 | Jones |
| 1,940,377 | A | 12/1933 | Storm |
| 1,946,648 | A | 2/1934 | Taylor |
| 1,953,306 | A | 4/1934 | Moratz |
| 1,986,739 | A | 1/1935 | Mitte |
| 1,988,201 | A | 1/1935 | Hall |
| 2,023,066 | A | 12/1935 | Curtis et al. |
| 2,044,216 | A | 6/1936 | Klages |
| 2,065,525 | A | 12/1936 | Hamilton |
| 2,123,409 | A | 7/1938 | Elmendorf |
| 2,220,606 | A | 11/1940 | Malarkey et al. |
| 2,276,071 | A | 3/1942 | Scull |
| 2,280,071 | A | 4/1942 | Hamilton |
| 2,324,628 | A | 7/1943 | Kähr |
| 2,328,051 | A | 8/1943 | Bull |
| 2,398,632 | A | 4/1946 | Frost et al. |
| 2,430,200 | A | 11/1947 | Wilson |
| 2,740,167 | A | 4/1956 | Rowley |
| 2,894,292 | A | 7/1959 | Gramelspacker |
| 3,045,294 | A | 7/1962 | Livezey, Jr. |
| 3,100,556 | A | 4/1963 | De Ridder |
| 3,125,138 | A | 3/1964 | Bolenbach |
| 3,182,769 | A | 5/1965 | De Ridder |
| 3,203,149 | A | 8/1965 | Soddy |
| 3,204,380 | A | 9/1965 | Smith et al. |
| 3,267,630 | A | 8/1966 | Omholt |
| 3,282,010 | A | 11/1966 | King, Jr. |
| 3,310,919 | A | 3/1967 | Bue et al. |
| 3,347,048 | A | 10/1967 | Brown et al. |
| 3,460,304 | A | 8/1969 | Braeuninger et al. |
| 3,481,810 | A | 12/1969 | Waite |
| 3,526,420 | A | 9/1970 | Brancaleone |
| 3,538,665 | A | 11/1970 | Gohner |
| 3,553,919 | A | 1/1971 | Omholt |
| 3,555,762 | A | 1/1971 | Costanzo, Jr. |
| 3,608,258 | A | 9/1971 | Spratt |
| 3,694,983 | A | 10/1972 | Couquet |
| 3,714,747 | A | 2/1973 | Curran |
| 3,720,027 | A | 3/1973 | Christensen |
| 3,731,445 | A | 5/1973 | Hoffmann et al. |
| 3,759,007 | A | 9/1973 | Thiele |
| 3,760,548 | A | 9/1973 | Sauer et al. |
| 3,768,846 | A | 10/1973 | Hensley et al. |
| 3,859,000 | A | 1/1975 | Webster |
| 3,878,030 | A | 4/1975 | Cook |
| 3,902,293 | A | 9/1975 | Witt et al. |
| 3,908,053 | A | 9/1975 | Hettich |
| 3,936,551 | A | 2/1976 | Elmendorf et al. |
| 3,988,187 | A | 10/1976 | Witt et al. |
| 4,006,048 | A | 2/1977 | Cannady, Jr. et al. |
| 4,090,338 | A | 5/1978 | Bourgade |
| 4,091,136 | A | 5/1978 | O'Brien et al. |
| 4,099,358 | A | 7/1978 | Compaan |
| 4,103,056 | A | 7/1978 | Baratto et al. |
| 4,118,533 | A | 10/1978 | Hipchen et al. |
| 4,131,705 | A | 12/1978 | Kubinsky |
| 4,164,832 | A | 8/1979 | Van Zandt |
| 4,169,688 | A | 10/1979 | Toshio |
| 4,242,390 | A | 12/1980 | Nemeth |
| 4,243,716 | A | 1/1981 | Kosaka et al. |
| 4,245,689 | A | 1/1981 | Grard et al. |
| 4,246,310 | A | 1/1981 | Hunt et al. |
| 4,290,248 | A | 9/1981 | Kemerer et al. |
| 4,299,070 | A | 11/1981 | Oltmanns et al. |
| 4,426,820 | A | 1/1984 | Terbrack et al. |
| 4,431,044 | A | 2/1984 | Bruneau |
| 4,471,012 | A | 9/1984 | Maxwell |
| 4,501,102 | A | 2/1985 | Knowles |
| 4,561,233 | A | 12/1985 | Harter et al. |
| 4,585,685 | A | 4/1986 | Forry et al. |
| 4,612,745 | A | 9/1986 | Hovde |
| 4,641,469 | A | 2/1987 | Wood |
| 4,653,242 | A | 3/1987 | Ezard |
| 4,654,244 | A | 3/1987 | Eckert et al. |
| 4,703,597 | A | 11/1987 | Eggemar |
| 4,715,162 | A | 12/1987 | Brightwell |
| 4,738,071 | A | 4/1988 | Ezard |
| 4,752,497 | A | 6/1988 | McConkey et al. |
| 4,769,963 | A | 9/1988 | Meyerson |
| 4,819,932 | A | 4/1989 | Trotter, Jr. |
| 4,831,806 | A | 5/1989 | Niese et al. |
| 4,845,907 | A | 7/1989 | Meek |
| 4,905,442 | A | 3/1990 | Daniels |
| 4,947,602 | A | 8/1990 | Pollasky |
| 1,124,228 | A | 1/1991 | Houston |
| 5,029,425 | A | 7/1991 | Bogataj |
| 5,103,614 | A | 4/1992 | Kawaguchi et al. |
| 5,113,632 | A | 5/1992 | Hanson |
| 5,117,603 | A | 6/1992 | Weintraub |
| 5,136,823 | A | 8/1992 | Pellegrino |
| 5,165,816 | A | 11/1992 | Parasin |
| 5,179,812 | A | 1/1993 | Hill |
| 5,205,091 | A | 4/1993 | Brown |
| 5,216,861 | A | 6/1993 | Meyerson |
| 5,251,996 | A | 10/1993 | Hiller et al. |
| 5,253,464 | A | 10/1993 | Nilsen |
| 5,283,102 | A | 2/1994 | Sweet et al. |
| 5,295,341 | A | 3/1994 | Kajiwara |
| 5,335,473 | A | 8/1994 | Chase |
| 5,348,778 | A | 9/1994 | Knipp et al. |
| 5,349,796 | A | 9/1994 | Meyerson |
| 5,390,457 | A | 2/1995 | Sjölander |
| 5,413,834 | A | 5/1995 | Hunter et al. |
| 5,433,806 | A | 7/1995 | Pasquali et al. |
| 5,474,831 | A | 12/1995 | Nystrom |
| 5,497,589 | A | 3/1996 | Porter |
| 5,502,939 | A | 4/1996 | Zadok et al. |
| 5,540,025 | A | 7/1996 | Takehara et al. |
| 5,567,497 | A | 10/1996 | Zegler et al. |
| 5,570,554 | A | 11/1996 | Searer |
| 5,597,024 | A | 1/1997 | Bolyard et al. |
| 5,630,304 | A | 5/1997 | Austin |
| 5,653,099 | A | 8/1997 | MacKenzie |
| 5,671,575 | A | 9/1997 | Wu |
| 5,694,734 | A | 12/1997 | Cercone et al. |
| 5,706,621 | A | 1/1998 | Pervan |
| 5,736,227 | A | 4/1998 | Sweet et al. |
| 5,768,850 | A | 6/1998 | Chen |
| 5,797,175 | A | 8/1998 | Schneider |
| 5,797,237 | A | 8/1998 | Finkell, Jr. |
| 5,823,240 | A | 10/1998 | Bolyard et al. |
| 5,827,592 | A | 10/1998 | Van Gulik et al. |
| 5,860,267 | A | 1/1999 | Pervan |
| 5,935,668 | A | 8/1999 | Smith |
| 5,943,239 | A | 8/1999 | Shamblin et al. |
| 5,953,878 | A | 9/1999 | Johnson |
| 5,968,625 | A | 10/1999 | Hudson |
| 5,985,397 | A | 11/1999 | Witt et al. |
| 5,987,839 | A | 11/1999 | Hamar et al. |
| 6,006,486 | A | 12/1999 | Moriau et al. |
| 6,023,907 | A | 2/2000 | Pervan |
| 6,065,262 | A | 5/2000 | Motta |
| 6,094,882 | A | 8/2000 | Pervan |
| 6,101,778 | A | 8/2000 | Martensson |
| 6,119,423 | A | 9/2000 | Costantino |
| 6,134,854 | A | 10/2000 | Stanchfield |
| 6,148,884 | A | 11/2000 | Bolyard et al. |
| 6,168,866 | B1 | 1/2001 | Clark |
| 6,182,410 | B1 | 2/2001 | Pervan |
| 6,186,703 | B1 | 2/2001 | Shaw |
| 6,205,639 | B1 | 3/2001 | Pervan |
| 6,209,278 | B1 | 4/2001 | Tychsen |
| 6,216,403 | B1 | 4/2001 | Belbeoc'h |
| 6,216,409 | B1 | 4/2001 | Roy et al. |
| D442,296 | S | 5/2001 | Külik |
| D442,297 | S | 5/2001 | Külik |
| D442,298 | S | 5/2001 | Külik |

(56) References Cited

U.S. PATENT DOCUMENTS

| | | | |
|---|---|---|---|
| D442,706 | S | 5/2001 | Külik |
| D442,707 | S | 5/2001 | Külik |
| 6,224,698 | B1 | 5/2001 | Endo |
| 6,238,798 | B1 | 5/2001 | Kang et al. |
| 6,247,285 | B1 | 6/2001 | Moebus |
| D449,119 | S | 10/2001 | Külik |
| D449,391 | S | 10/2001 | Külik |
| D449,392 | S | 10/2001 | Külik |
| 6,324,803 | B1 | 12/2001 | Pervan |
| 6,345,481 | B1 | 2/2002 | Nelson |
| 6,363,677 | B1 | 4/2002 | Chen et al. |
| 6,397,547 | B1 | 6/2002 | Martensson |
| 6,418,683 | B1 | 7/2002 | Martensson et al. |
| 6,421,970 | B1 | 7/2002 | Martensson et al. |
| 6,427,408 | B1 | 8/2002 | Krieger |
| 6,436,159 | B1 | 8/2002 | Safta et al. |
| 6,438,919 | B1 | 8/2002 | Knauseder |
| 6,446,405 | B1 | 9/2002 | Pervan |
| 6,449,913 | B1 | 9/2002 | Shelton |
| 6,449,918 | B1 | 9/2002 | Nelson |
| 6,453,632 | B1 | 9/2002 | Huang |
| 6,458,232 | B1 | 10/2002 | Valentinsson |
| 6,460,306 | B1 | 10/2002 | Nelson |
| 6,461,636 | B1 | 10/2002 | Arth et al. |
| 6,465,046 | B1 | 10/2002 | Hansson et al. |
| 6,490,836 | B1 | 12/2002 | Moriau et al. |
| 6,497,961 | B2 | 12/2002 | Kang et al. |
| 6,510,665 | B2 | 1/2003 | Pervan |
| 6,516,579 | B1 | 2/2003 | Pervan |
| 6,517,935 | B1 | 2/2003 | Kornfalt et al. |
| 6,519,912 | B1 | 2/2003 | Eckmann et al. |
| 6,521,314 | B2 | 2/2003 | Tychsen |
| 6,532,709 | B2 | 3/2003 | Pervan |
| 6,533,855 | B1 | 3/2003 | Gaynor et al. |
| 6,536,178 | B1 | 3/2003 | Påalsson et al. |
| 6,546,691 | B2 | 4/2003 | Leopolder |
| 6,553,724 | B1 | 4/2003 | Bigler |
| 6,558,754 | B1 | 5/2003 | Velin et al. |
| 6,565,919 | B1 | 5/2003 | Hansson et al. |
| 6,569,272 | B2 | 5/2003 | Tychsen |
| 6,588,166 | B2 | 7/2003 | Martensson et al. |
| 6,591,568 | B1 | 7/2003 | Palsson |
| 6,601,359 | B2 | 8/2003 | Olofsson |
| 6,606,834 | B2 | 8/2003 | Martensson et al. |
| 6,617,009 | B1 | 9/2003 | Chen et al. |
| 6,635,174 | B1 | 10/2003 | Berg et al. |
| 6,641,629 | B2 | 11/2003 | Safta et al. |
| 6,646,088 | B2 | 11/2003 | Fan et al. |
| 6,647,690 | B1 | 11/2003 | Martensson |
| 6,649,687 | B1 | 11/2003 | Gheewala et al. |
| 6,659,097 | B1 | 12/2003 | Houston |
| 6,672,030 | B2 | 1/2004 | Schulte |
| 6,681,820 | B2 | 1/2004 | Olofsson |
| 6,682,254 | B1 | 1/2004 | Olofsson et al. |
| 6,685,993 | B1 | 2/2004 | Hansson et al. |
| 6,711,864 | B2 | 3/2004 | Erwin |
| 6,711,869 | B2 | 3/2004 | Tychsen |
| 6,715,253 | B2 | 4/2004 | Pervan |
| 6,723,438 | B2 | 4/2004 | Chang et al. |
| 6,729,091 | B1 | 5/2004 | Martensson |
| 6,745,534 | B2 | 6/2004 | Kornfalt |
| 6,761,008 | B2 | 7/2004 | Chen et al. |
| 6,761,794 | B2 | 7/2004 | Mott et al. |
| 6,763,643 | B1 | 7/2004 | Martensson |
| 6,766,622 | B1 | 7/2004 | Thiers |
| 6,769,217 | B2 | 8/2004 | Nelson |
| 6,769,218 | B2 | 8/2004 | Pervan |
| 6,769,835 | B2 | 8/2004 | Stridsman |
| 6,772,568 | B2 | 8/2004 | Thiers et al. |
| 6,786,019 | B2 | 9/2004 | Thiers |
| 6,803,109 | B2 | 10/2004 | Qiu et al. |
| 6,805,951 | B2 | 10/2004 | Kornfält et al. |
| 6,823,638 | B2 | 11/2004 | Stanchfield |
| 6,841,023 | B2 | 1/2005 | Mott |
| 2001/0029720 | A1 | 10/2001 | Pervan |
| 2001/0034992 | A1 | 11/2001 | Pletzer et al. |
| 2002/0007608 | A1 | 1/2002 | Pervan |
| 2002/0007609 | A1 | 1/2002 | Pervan |
| 2002/0014047 | A1 | 2/2002 | Thiers |
| 2002/0020127 | A1 | 2/2002 | Thiers et al. |
| 2002/0046528 | A1 | 4/2002 | Pervan et al. |
| 2002/0056245 | A1 | 5/2002 | Thiers |
| 2002/0106439 | A1 | 8/2002 | Cappelle |
| 2003/0024200 | A1 | 2/2003 | Moriau et al. |
| 2003/0024201 | A1 | 2/2003 | Moriau et al. |
| 2003/0029115 | A1 | 2/2003 | Moriau et al. |
| 2003/0029116 | A1 | 2/2003 | Moriau et al. |
| 2003/0029117 | A1 | 2/2003 | Moriau et al. |
| 2003/0033777 | A1 | 2/2003 | Thiers et al. |
| 2003/0033784 | A1 | 2/2003 | Pervan |
| 2003/0115812 | A1 | 6/2003 | Pervan |
| 2003/0115821 | A1 | 6/2003 | Pervan |
| 2003/0159385 | A1 | 8/2003 | Thiers |
| 2003/0167717 | A1 | 9/2003 | Garcia |
| 2003/0196405 | A1 | 10/2003 | Pervan |
| 2003/0205013 | A1 | 11/2003 | Garcia |
| 2003/0207083 | A1 | 11/2003 | Hansson et al. |
| 2003/0233809 | A1 | 12/2003 | Pervan |
| 2004/0016196 | A1 | 1/2004 | Pervan |
| 2004/0035078 | A1 | 2/2004 | Pervan |
| 2004/0092006 | A1 | 5/2004 | Lindekens et al. |
| 2004/0105994 | A1 | 6/2004 | Lu et al. |
| 2004/0139678 | A1 | 7/2004 | Pervan |
| 2004/0159066 | A1 | 8/2004 | Thiers et al. |
| 2004/0177584 | A1 | 9/2004 | Pervan |
| 2004/0191547 | A1 | 9/2004 | Oldorff |
| 2004/0200165 | A1 | 10/2004 | Garcia et al. |
| 2004/0206036 | A1 | 10/2004 | Pervan |
| 2004/0237447 | A1 | 12/2004 | Thiers et al. |
| 2004/0237448 | A1 | 12/2004 | Thiers et al. |
| 2004/0241374 | A1 | 12/2004 | Thiers et al. |
| 2004/0244322 | A1 | 12/2004 | Thiers et al. |
| 2004/0250493 | A1 | 12/2004 | Thiers et al. |
| 2004/0255541 | A1 | 12/2004 | Thiers et al. |
| 2004/0258907 | A1 | 12/2004 | Kornfalt et al. |
| 2005/0003149 | A1 | 1/2005 | Kornfalt et al. |
| 2005/0016099 | A1 | 1/2005 | Thiers |
| 2005/0076598 | A1 | 4/2005 | Lewark |
| 2005/0235593 | A1 | 10/2005 | Hecht |
| 2005/0255250 | A1* | 11/2005 | Becker-Weimann et al. 427/377 |
| 2007/0283648 | A1* | 12/2007 | Chen ..... 52/313 |

FOREIGN PATENT DOCUMENTS

| | | |
|---|---|---|
| DE | 1089966 | 9/1960 |
| DE | 73 31 322 | 11/1973 |
| DE | 41 31 223 | 9/1991 |
| DE | 29 517128 | 2/1996 |
| DE | 19 718319 | 11/1998 |
| DE | 203 15 676 | 10/2003 |
| DE | 203 17 527 | 11/2003 |
| DE | 20 2004 001 037 | 1/2004 |
| EP | 0248127 | 12/1987 |
| EP | 07180333 | 7/1995 |
| EP | 0849416 | 6/1998 |
| EP | 0698162 | 9/1998 |
| EP | 0903451 | 3/1999 |
| EP | 0855482 | 12/1999 |
| EP | 0877130 | 1/2000 |
| EP | 0969163 | 1/2000 |
| EP | 0843763 | 10/2000 |
| EP | 1262607 A1 | 5/2001 |
| EP | 1 262 313 | 5/2002 |
| EP | 0958441 | 7/2003 |
| EP | 1 454 763 | 9/2003 |
| GB | 424057 | 2/1935 |
| GB | 1033866 | 6/1966 |
| GB | 1034117 | 6/1966 |
| GB | 1237744 | 6/1968 |
| GB | 1127915 | 9/1968 |
| GB | 1275511 | 5/1972 |
| GB | 1399402 | 7/1975 |
| GB | 1430423 | 3/1976 |
| GB | 2117813 | 10/1983 |

(56) References Cited

FOREIGN PATENT DOCUMENTS

| | | |
|---|---|---|
| GB | 2152063 | 7/1985 |
| GB | 2256023 | 11/1992 |
| JP | 3-169967 | 7/1991 |
| JP | 8-109734 | 4/1996 |
| SE | 450411 | 6/1987 |
| WO | 84/02155 | 6/1984 |
| WO | 89/08539 | 9/1989 |
| WO | 92/17657 | 10/1992 |
| WO | 93/13280 | 7/1993 |
| WO | 94/01628 | 1/1994 |
| WO | 9426999 | 11/1994 |
| WO | 95/06176 | 3/1995 |
| WO | 96/27719 | 9/1996 |
| WO | 96/30177 | 10/1996 |
| WO | 97/47834 | 12/1997 |
| WO | 98/24495 | 6/1998 |
| WO | 98/24994 | 6/1998 |
| WO | 98/38401 | 9/1998 |
| WO | 99/66151 | 12/1999 |
| WO | 01/48333 | 7/2001 |
| WO | 01/96688 | 12/2001 |
| WO | 2005/066431 | 7/2005 |

* cited by examiner

BUILDING BOARD HAVING A PATTERN APPLIED ONTO SIDE SURFACES AND CONECTING MECHANISMS THEREOF

CROSS-REFERENCE TO RELATED APPLICATIONS

The present application claims priority under 35 U.S.C. §119 of German Patent Application No. 10 2005 042 658.1, filed on Sep. 8, 2005, the disclosure of which is expressly incorporated by reference herein in its entirety.

BACKGROUND OF THE INVENTION

1. Field of the Invention

The invention relates to a building board and, more particularly, a flooring panel of a wooden material, with a top and an underside, in which at least the top is provided with a decorative layer imitating a natural material.

2. Discussion of Background Information

Flooring panels have a pattern and a structure embossing adapted to the pattern on the top surface in the laid condition, whereby a natural material, e.g., wood or stone, is to be imitated. A pattern and/or a structure can also be present on the underside. Wooden materials such as HDF, MDF or OSB boards are used as the base board material.

The patterns that are applied onto the board materials can be printed onto a paper layer or directly onto the board-like base. Patterns of this type are, e.g., wood or stone imitations.

An embossing providing a structure is often superimposed on the pattern. The pattern and embossing are preferably matched to one another, so-called synchronized grain structure (embossed in register), in order to make the visible surfaces as close as possible to the natural material in terms of appearance and structure.

Laminate flooring panels of this type increasingly also have peripheral chamfers that remain visible when laid. The chamfers form V-joints. The peripheral chamfers are also decorated. To this end, the peripheral chamfers are embodied in a solid color or continue the pattern of the visible surface and optionally also have a structure embossing synchronous with the pattern, so that the impression in terms of appearance and structure is intensified with regard to a natural material.

The side surfaces, where the tongue and groove, connecting means and optionally also locking elements are formed, and which as purely functional surfaces are not visible when laid, show the base material, e.g., HDF, MDF or OSB. The impression of a perfect imitation of a natural material is therefore lost for the observer. A reduction in the impression of quality for the consumer of such flooring panels is often caused by the lack of such decorative cover in these areas. Moreover, moisture can penetrate the base material via the side surfaces, which can lead to a swelling of the panel and to the destruction of the floor.

Applications that are applied to the side surfaces of boards in order to seal them are known. Side surfaces of furniture boards are, for example, provided with veneer tapes. It is also known to draw a film around the side surfaces. However, only straight side surfaces without functional surfaces are sealed.

The side surfaces of flooring panels are embodied as functional surfaces and have laboriously formed connecting mechanisms and optionally locking elements. That is, these side surfaces are not straight surfaces. It is known to apply applications containing wax onto the locking elements. But, these applications are exclusively function-oriented and are used to avoid creaking noises in connected laminate flooring panels as well as for the water-repellent treatment of the wooden material base board.

The disadvantage is that the side surfaces cannot be completely or permanently sealed with applications containing wax. A particular drawback is that the base material of the flooring panel is not covered in the case of applications containing wax for water-repellent treatment. The imitation of a natural material thus remains imperfect with flooring panels of this type. The impression of a perfect imitation of a natural material is routinely lost when the side surfaces of such flooring panels are observed.

SUMMARY OF THE INVENTION

By the present invention, based on the above problem, a building board is improved in that the side surfaces are matched as perfectly as possible in terms of appearance and structure to the material to be imitated and a permanent seal against environmental influences is achieved.

In the invention, a building board has at least one side surface and at least one connecting mechanism provided with a pattern. Preferably all the side surfaces, including the connecting mechanism and the underside of the building board are provided with a pattern that imitates the same natural material as the decorative layer on the top, taking into account the position.

The impression of a natural material is reinforced because at least one side surface is provided with a pattern imitating a natural material. If all the side surfaces including all the connecting mechanisms and the underside are provided with a pattern, the impression that this is a natural material is almost perfect. With a wood pattern, for example, the position of the decorated surface can be taken into consideration. The structural pattern (grain) is matched to the end-to-end grain at the end edges. The grain pattern of the surface can be continued accordingly at the side edges and the formed connecting mechanisms.

If the building board has a peripheral edge, e.g., a chamfer, on its side surfaces, it is advantageous to provide it with a pattern imitating a natural material so that the base material is not visible in the area of the chamfer and the impression of the most perfect possible imitation of a natural material can also be produced at the edge surfaces.

On the side surfaces the building board can be provided with locking elements for the mechanical locking of several building boards to one another, so that a simple locking of the building boards free from glue and thus a time-saving laying of the building boards can be achieved. The locking elements are also provided with a pattern imitating a natural material so that the observer has the impression of a perfect imitation of a natural material when observing the side surfaces.

Standard printing inks are advantageously used as decorative inks so that a cost-effective production of the pattern can be achieved.

It is particularly advantageous to cover the pattern on the side surfaces with a waterproof, sealing termination layer, which can comprise, e.g., a polyurethane coating. Thus, the swell and shrink of the building board triggered by moisture exposure can be reduced and the building board can also be used in fields of application with increased moisture loading, e.g., in the bathroom area.

In order to increase the optically perfectly imitated impression of a natural material even further, a structural embossed pattern can be embossed into the sealing polyurethane coating. In this manner, pattern and structure are advantageously matched to one another so that, e.g., with a wood structure, the imprinted pores are provided with a corresponding indentation in the polyurethane coating.

It has been proven that creaking noises of building boards connected to one another, which are caused by friction of the building boards among each another, can be permanently avoided through a polyurethane coating. It is particularly advantageous that a precision fitted connection of the building boards among one another can be achieved through the polyurethane coating, even if surface irregularities and/or smaller dimensional variations due to manufacturing tolerances occur, since they can be equalized by the elastic polyurethane coating. High-quality products can thus be manufactured.

The application of the pattern onto the side surfaces can be carried out by use of a cylinder printing mechanism in order to ensure a rapid, continuous and cost-effective production of these building boards. In order to increase production capacity, several cylinder printing mechanisms can also be operated in series, which mechanisms apply the pattern onto the side surfaces, onto the peripheral edge, onto the connecting means and onto the locking mechanisms. Expediently the cylinder printing mechanisms are profiled according to the design of the connecting mechanisms or the side surfaces of the building board in order to ensure that the pattern is also applied to all the surfaces of the connecting mechanisms or the side surfaces or the locking mechanisms.

It is also possible to apply the pattern by use of one or more digital printers, whereby the application can be simplified even further.

Alternatively, the application of the pattern is also possible by use of at least one spray painting mechanism, e.g., by so-called vacumats in which the air flow carrying the ink particles is suctioned off after transferring the ink particles directed onto the surface to be coated. The manufacture of the building boards can thus also be adapted to different conditions of the manufacturing plant in terms of mechanical equipment.

It is also advantageous to apply a waterproof termination layer, e.g., of polyurethane, onto the decorative layer in order to produce an elastic surface on the building board that is nevertheless more resistant to mechanical stress. This sealing polyurethane coating can be applied by use of one or more cylinder printing mechanisms or spray painting mechanisms. In addition to polyurethane-based coatings, plastics or varnishes, such as, e.g., UV-curable or electron beam curable varnishes, can be used. Plastics or the varnishes described above can also be added to the polyurethane coating.

A structure can be embossed into this termination layer with at least one structure-embossing roller so that pattern and structure correspond to a natural product and are matched to the pattern of the top of the building board.

A permanent reduction of the hygroscopic properties of the building boards is ensured through the waterproof coating of the building board. High quality products can thus be produced which have a reduced swell and shrink behavior.

In a further embodiment, a building board comprises a top surface and an underside surface. At least the top surface has a decorative layer having a pattern imitating a natural material. Side peripheral surfaces are along edges of at least the top surface and connecting mechanisms are provided along the side peripheral surfaces. At least one side peripheral surface and at least one connecting mechanism include the pattern imitating the natural product.

Each of the side surfaces has the pattern imitating the natural product. Each of the connecting mechanisms has the pattern imitating the natural product. The underside has the pattern imitating the natural product. At least one of the peripheral side surfaces is an end, transverse to longitudinal sides of the building board, where the pattern on the end surface is matched to an end-to-end grain.

The building board further comprises a chamfer, on the peripheral side surfaces. The chamfer has the pattern imitating the natural product such that base material is not visible on the chamfer. The connecting mechanism includes locking elements for mechanical locking of adjacent building boards to one another. The locking elements are provided with the pattern imitating the natural product. A waterproof sealing termination layer is provided on the peripheral side surfaces. The waterproof, sealing termination layer has a structural embossed pattern. The chamfer has the pattern imitating a natural product and is coordinated with an optical design of the decorative layer of the side surfaces and the top and/or the underside.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
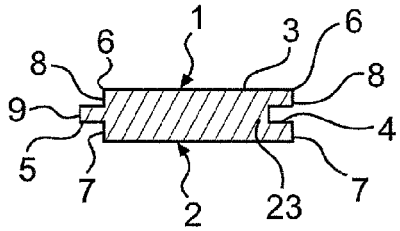
FIG. 1 shows a cross sectional view of a building board in accordance with the invention.

FIG. 1 shows a building board with a top 1 and an underside 2, which has a decorative layer 3 imitating a natural material on the top 1 and the underside 2. The building board has a chamfer 6 and connecting mechanism 4 and 5 corresponding to one another on opposite sides. The side surfaces 7, 8, 9 are likewise provided with a pattern imitating a natural material. The side surfaces 7, 8, 9 are along the longitudinal and transverse sides of the building board. The chamfer 6 is provided on an upper edge of the side surfaces 7, 8, 9, and in one embodiment extends about a perimeter of the building board, at an upper surface thereof.

The pattern of the chamfer 6 and the side surfaces 7, 8, 9 is coordinated with the optical design of the decorative layer 3 of the top 1 or the underside 2 of the building board and has been applied by use of several cylinder printing mechanisms. Following the application of the pattern, a polyurethane coating 20 takes place of the side surfaces 7, 8, 9 and of the connecting mechanisms 4, 5 corresponding to one another and of the chamfer 6. Expediently the polyurethane coating can likewise be applied with a cylinder printing mechanism. A structural embossing 21 imitating a natural material is embossed into the sealing polyurethane coating by use of a structure-embossing roller 11. Pattern and structure are thereby coordinated with one another in order to render a virtually perfect imitation of a natural material.

Figure 2:
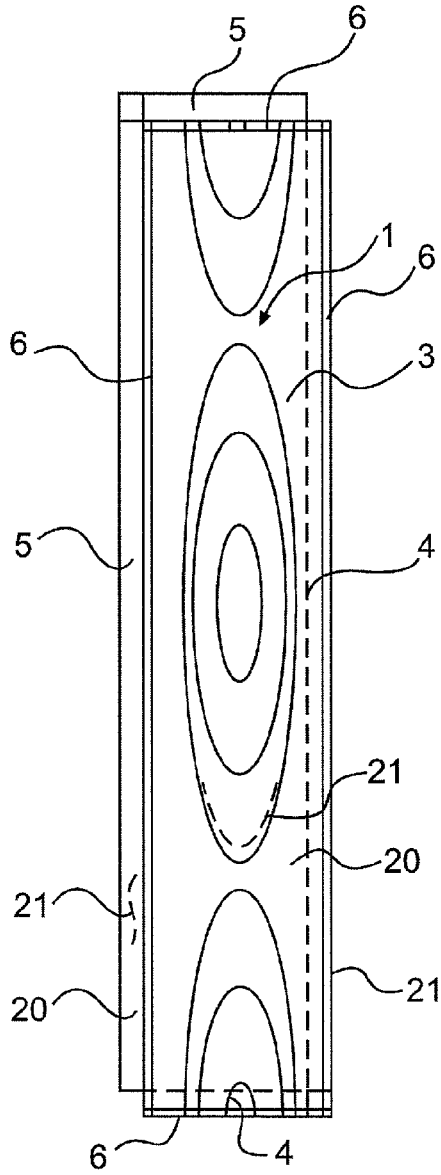
FIG. 2 shows a plan view of a building board in accordance with the invention.

FIG. 2 shows a plan view of a building board in accordance with the invention. In this view, it is shown that the building board 1 has a top 1, connecting mechanisms 4 and 5 corresponding to one another and lying opposite one another, and a chamfer 6. The top 1 and the underside 2 of the building board are provided with a decorative layer 3 imitating a wood pattern. A waterproof polyurethane coating 20 is applied onto the decorative layer 3, into which coating a wood structure is embossed. Wood graining and structural embossing are matched to one another such that a virtually perfect imitation of a natural wood board is produced, whereby the position of the surface is taken into consideration. The pattern on the end face is chosen such that the impression of end-to-end grain 23 is produced.

Figure 3:
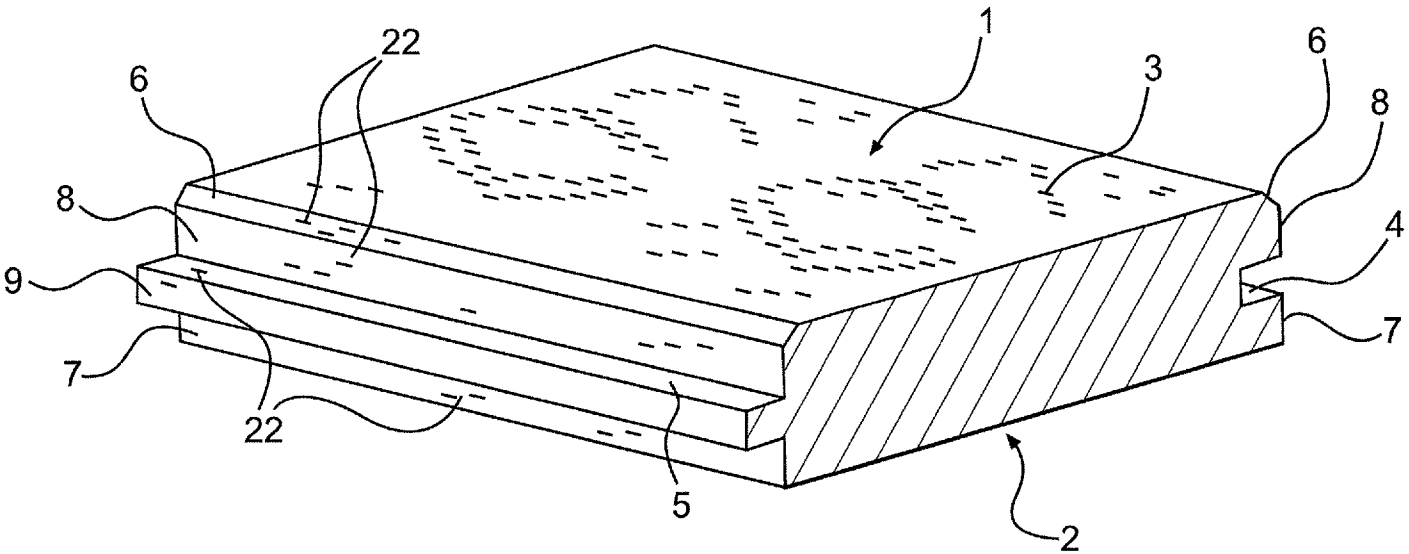
FIG. 3 shows a perspective view of the building board in accordance with the invention.

FIG. 3 shows a perspective view of a building board in accordance with the invention. In this view, it is shown that the building board 1 has a top 1 and an underside 2, in which a decorative layer 3 is applied onto the top 1 and alternatively also onto the underside 2. A pattern 22 is also applied onto the side surfaces 7, 8, 9 and the connecting mechanisms 4, 5 and the chamfer 6, whereby this pattern is adapted to the optical design of the decorative layer 3 on the top 1 of the building board. A termination layer 20 of polyurethane is applied onto the decorative layer 3 and onto the pattern of the side surfaces 7, 8, 9 of the connecting mechanisms 4, 5 and onto the chamfer 6, into which layer a structure 21 is embossed corresponding to the pattern of the side surfaces 7, 8, 9, the connecting mechanisms 4, 5, the chamfer 6 and the decorative layer 3 on the top 1 of the building board, in order to produce a virtually perfect imitation of a natural material.

Figure 4:
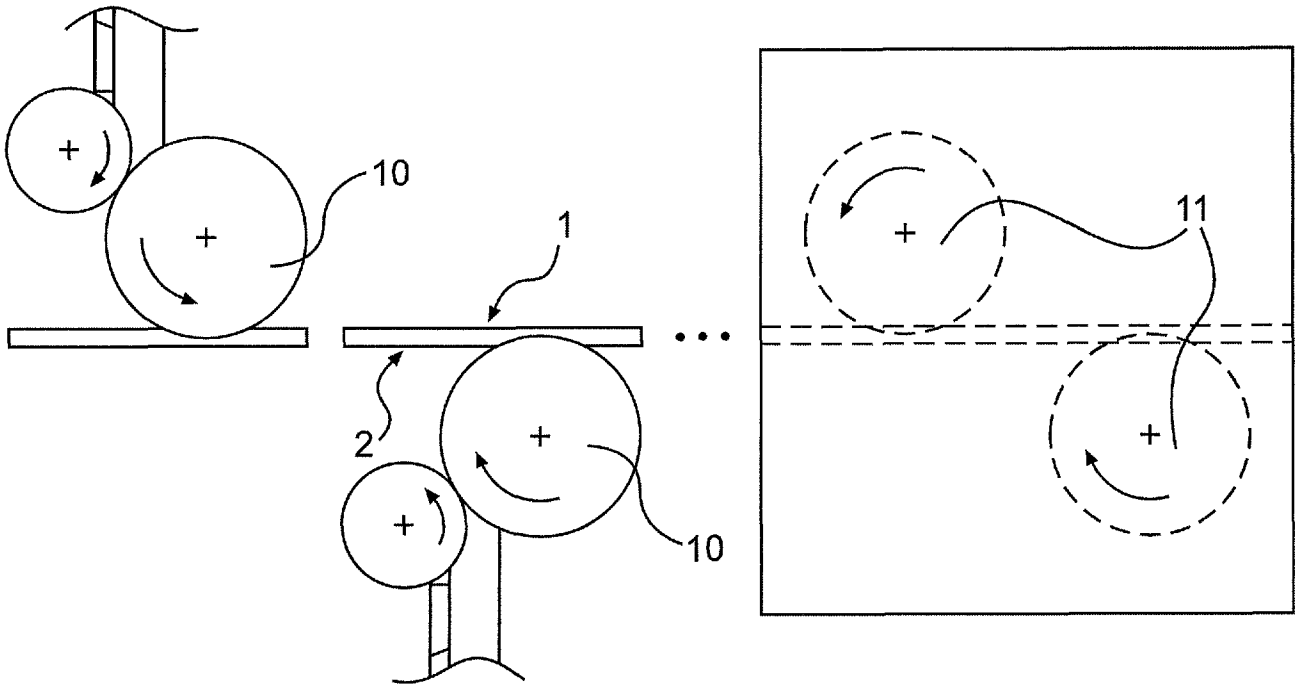
FIG. 4 shows a process description for producing the building board in accordance with the invention.

FIG. 4 shows a device for producing the building board according to the invention with two cylinder printing mechanisms 10 that apply the decorative layer 3 onto the top 1 of the building board and onto the peripheral sides 7, 8, 9, onto the connecting mechanisms 4, 5 and onto the chamfer 6. The roller of the cylinder printing mechanism 10 is profiled so that a reliable ink application occurs on all the surfaces of the building board. The structuring rollers 11 emboss a surface structure corresponding to the respective pattern into the connecting mechanisms 4, 5, the peripheral side surfaces 7, 8, 9 and the chamfer 6.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A building board, comprising:

a top surface and an underside, at least the top surface has a decorative layer having a pattern imitating a natural material;

side peripheral surfaces along edges of at least the top surface;

a waterproof sealing termination layer covering the decorative layer; and connecting mechanisms provided along the side peripheral surfaces, wherein at least one side peripheral surface of the side peripheral surfaces and at least one connecting mechanism of the connecting mechanisms include the pattern imitating the natural material, wherein the pattern is ink or spray and the waterproof sealing termination layer has an embossing structure that matches the pattern.

2. The building board of claim 1, wherein each of the side peripheral surfaces has the pattern imitating the natural material.

3. The building board of claim 2, wherein each of the connecting mechanisms has the pattern imitating the natural material.

4. The building board of claim 3, wherein the underside has the pattern imitating the natural material.

5. The building board of claim 1, wherein at least one of the side peripheral surfaces is an end, transverse to longitudinal sides of the building board, the pattern on the end is matched to an end-to-end grain.

6. The building board of claim 1, further comprising a chamfer, on the side peripheral surfaces, the chamfer having the pattern imitating the natural material such that base material is not visible on the chamfer.

7. The building panel of claim 1, wherein the connecting mechanisms include locking elements for mechanical locking of adjacent building boards to one another, the locking elements are provided with the pattern imitating the natural material.

8. The building panel of claim 1, wherein the waterproof sealing termination layer is on the side peripheral surfaces.

9. The building panel of claim 8, wherein the waterproof sealing termination layer has a structural embossed pattern.

10. The building panel of claim 4, further comprising a chamfer on the side peripheral surfaces, wherein the chamfer has the pattern imitating the natural material and is coordinated with an optical design of the decorative layer of the side currently amended surfaces and at least one of the top and the underside.

11. A building board, comprising:

a top surface and an underside, at least the top surface has a decorative layer having a pattern imitating a natural material;

side peripheral surfaces along edges of at least the top surface; and connecting mechanisms provided along the side peripheral surfaces, wherein at least one side peripheral surface of the side peripheral surfaces and at least one connecting mechanism include the pattern imitating the natural material, and wherein at least one of the side peripheral surfaces is an end surface, transverse to longitudinal sides of the building board, the pattern on the end surface is matched to an end-to-end grain, and a termination layer is applied over the pattern and a structure is embossed into the termination layer that matches the pattern.

* * * * *